US011297436B1

(12) United States Patent
Wen et al.

(10) Patent No.: US 11,297,436 B1
(45) Date of Patent: Apr. 5, 2022

(54) SOLID-MEDIUM SOUND CONDUCTING RECEIVER AND ELECTRONIC DEVICE WITH THE SAME

(71) Applicant: Transound Electronics Co., Ltd., Dongguan (CN)

(72) Inventors: Tseng-Feng Wen, Dongguan (CN); Hu-Ming Zheng, Dongguan (CN); Zhi-Jian He, Dongguan (CN); Yan-Fang Chen, Dongguan (CN)

(73) Assignee: Transound Electronics Co., Ltd., Dongguan (CN)

( * ) Notice: Subject to any disclaimer, the term of this patent is extended or adjusted under 35 U.S.C. 154(b) by 0 days.

(21) Appl. No.: 17/106,351

(22) Filed: Nov. 30, 2020

(30) Foreign Application Priority Data

Oct. 30, 2020 (CN) ..... 202022469677.3

(51) Int. Cl.
*H04R 9/06* (2006.01)
*H04R 9/04* (2006.01)
*H04R 9/02* (2006.01)
*H04R 11/06* (2006.01)

(52) U.S. Cl.
CPC ..... *H04R 9/045* (2013.01); *H04R 9/025* (2013.01); *H04R 9/06* (2013.01); *H04R 11/06* (2013.01); *H04R 2209/026* (2013.01); *H04R 2400/03* (2013.01); *H04R 2400/07* (2013.01); *H04R 2499/11* (2013.01)

(58) Field of Classification Search
CPC ..... H04R 9/025; H04R 9/045; H04R 9/06; H04R 9/063; H04R 11/06; H04R 2209/026; H04R 2400/03; H04R 2400/07; H04R 2499/11
See application file for complete search history.

(56) References Cited

U.S. PATENT DOCUMENTS 5,861,686 A * 1/1999 Lee ..... B06B 1/045 310/36
6,490,363 B1 * 12/2002 Liu ..... H04R 9/06 381/403
6,754,363 B2 * 6/2004 Chang ..... B06B 1/045 381/401
7,231,057 B2 * 6/2007 Kim ..... H04R 1/00 381/396
7,369,674 B2 * 5/2008 Miura ..... H04R 9/10 381/396
9,955,251 B1 * 4/2018 Zu ..... H04R 31/00
2013/0287245 A1 * 10/2013 Chen ..... H04R 9/06 381/398

* cited by examiner

*Primary Examiner* — Huyen D Le
(74) *Attorney, Agent, or Firm* — ScienBiziP, P.C.

(57) ABSTRACT

A conduction receiver utilizing sound transmission through a solid medium includes an outer casing, a vibration reed, a magnet, a washer, a coil, and a lid. The lid covers surfaces of the outer casing to form a sealed first receiving space. The vibration reed, the magnet, the washer, and the coil are all arranged in the first receiving space. A peripheral surface of the vibration reed is coupled to the outer casing. The magnet is arranged at a side of the vibration reed away from a bottom of the outer casing. The washer is arranged at a side of the magnet away from the vibration reed. A first end of the coil is fixed to an inner surface of the lid, and a second end of the coil extends into the first receiving space and is coiled around the magnet and the washer. An electronic device is also provided.

18 Claims, 5 Drawing Sheets

SOLID-MEDIUM SOUND CONDUCTING RECEIVER AND ELECTRONIC DEVICE WITH THE SAME

FIELD

The subject matter herein generally relates to sound receivers, and particularly, to a sound conducting receiver and an electronic device with the same.

BACKGROUND

Sound travels easily through solid matter such as metal or bone. The conduction of sound in a solid medium is by converting sound to mechanical vibration with different frequencies, and such vibrations or waves can be transmitted through the skull, bony labyrinths, linner ear lymphs, *Corti*'s organ, and the auditory hub. A telephone receiver is an electroacoustic device which converts electrical signals into sound. A conventional solid-medium conduction receiver (bone conduction receiver) includes a vibration reed, a holder, a magnet, a coil, and so on. The magnetic field intensity or strength of the conventional receiver is low, or ambient noise may adversely affect the transmission of sound in the conventional receiver.

SUMMARY

A more efficient solid-medium sound conducting receiver is required.

The present disclosure provides a conduction receiver of solid matter (that is, a solid medium for the transmission of sound, hereinafter "bone conduction receiver"). The bone conduction receiver includes an outer casing, a vibration reed, a magnet, a washer, a coil, and a lid. The lid covers surfaces of the outer casing to form a sealed first receiving space. The vibration reed, the magnet, the washer, and the coil are all arranged in the first receiving space. A peripheral surface of the vibration reed is coupled to the outer casing. The magnet is arranged at a side of the vibration reed away from a bottom of the outer casing. The washer is arranged at a side of the magnet away from the vibration reed. A first end of the coil is fixed to an inner surface of the lid, and a second end of the coil extends into the first receiving space and coils around the magnet and the washer.

In at least one embodiment, the lid is a printed circuit board. The bone conduction receiver further includes a filter circuit. The filter circuit is arranged on an outer surface of the lid.

In at least one embodiment, an edge of an end of the outer casing adjacent to the lid bends inwardly to form a limiting member. The limiting member and an outer surface of the lid away from the coil abut each other.

In at least one embodiment, the bone conduction receiver further includes a holder. The holder is arranged between the vibration reed and the magnet. The holder is configured to receive the magnet.

In at least one embodiment, the holder includes a first barrel member and a second barrel member. The first barrel member and the second barrel member are both cylindrical. An end of the first barrel member extends outside to form a connection member. The connection member is coupled to an end of the second barrel member. A space formed in the first barrel member and a space formed in the second barrel member communicate with each other. An inner diameter of the first barrel member is less than an inner diameter of the second barrel member. The magnet is partially received in the first barrel member. The magnet further extends toward the second barrel member and is spaced from an inner wall of the second barrel member.

In at least one embodiment, the first barrel member is adjacent to the vibration reed, and a gap exists between the connection member and the vibration reed.

In at least one embodiment, the coil surrounds the magnet and the washer. The coil is spaced from an outer wall of the magnet and an inner wall of the second barrel member.

In at least one embodiment, the bone conduction receiver further includes a cushion ring. The cushion ring is arranged on the bottom of the outer casing. An end of the cushion ring away from the outer casing and the vibration reed abut each other.

In at least one embodiment, the bone conduction receiver further includes a supporting base. The supporting base is arranged on the side of the vibration reed away from the cushion ring. The supporting base surrounds the holder and the magnet. An end of the supporting base away from the vibration reed and the lid abut each other.

An electronic device is also disclosed. The electronic device includes the bone conduction receiver. The bone conduction receiver includes an outer casing, a vibration reed, a magnet, a washer, a coil, and a lid. The lid covers surfaces of the outer casing to form a sealed first receiving space. The vibration reed, the magnet, the washer, and the coil are all arranged in the first receiving space. The peripheral surface of the vibration reed is coupled to the outer casing. The magnet is arranged at a side of the vibration reed away from a bottom of the outer casing. The washer is arranged at a side of the magnet away from the vibration reed. A first end of the coil is fixed to a first surface of the lid, and a second end of the coil extends into the first receiving space and coils around the magnet and the washer.

A washer is arranged on a surface of the magnet to amplify magnetic induction lines, thus a utilization of the magnet can be improved, and accordingly an integral acoustic performance of the bone conduction receiver can be improved. The outer casing and the lid are riveted, thus a seal of the bone conduction receiver can be ensured, and the bone conduction receiver is waterproof. The filter circuit is arranged on the outer surface of the lid, thus noise generated by the bone conduction receiver during operation can be filtered out, and an experience of the user can be accordingly improved.

BRIEF DESCRIPTION OF THE DRAWINGS

Implementations of the present technology will now be described, by way of embodiment, with reference to the attached figures.

DETAILED DESCRIPTION

A description of the present disclosure is in conjunction with drawings in the embodiments. Obviously, the described embodiments are merely a part of the embodiments of the present disclosure and not all the embodiments. Based on the embodiments of the present disclosure, all other embodiments obtained by those ordinarily skilled in the art without creative work fall within the protection scope of the present disclosure.

When one component is considered to "couple" or "couple to" another component, it may be directly connected to the other component or it is possible that there is a third component between them.

Unless otherwise defined, all the technical and scientific terms used in this specification convey the same meanings as the meanings commonly understood by a person skilled in the art. Additionally, the terms used in the specification the present disclosure are merely for describing the specific embodiments, and are not intended to limit the present disclosure.

Figure 1:
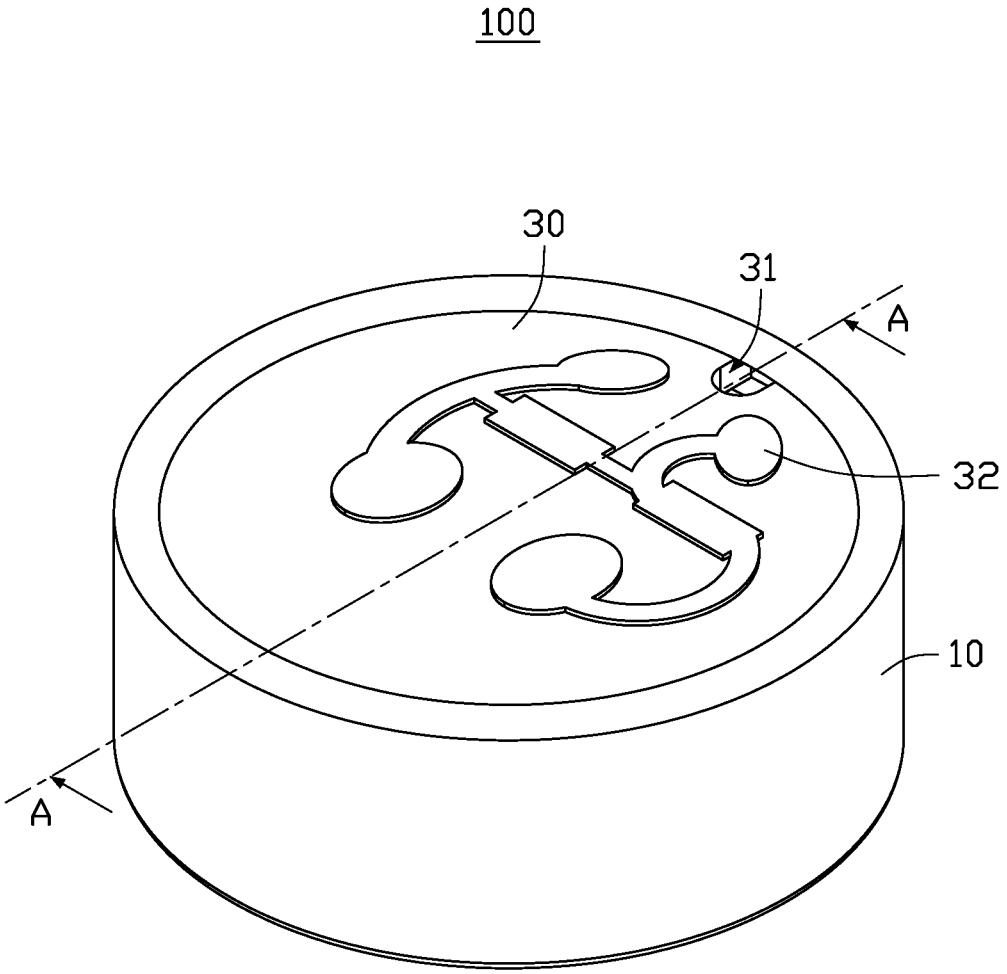
FIG. 1 is a schematic view of an assembled bone conduction receiver.
Figure 2:
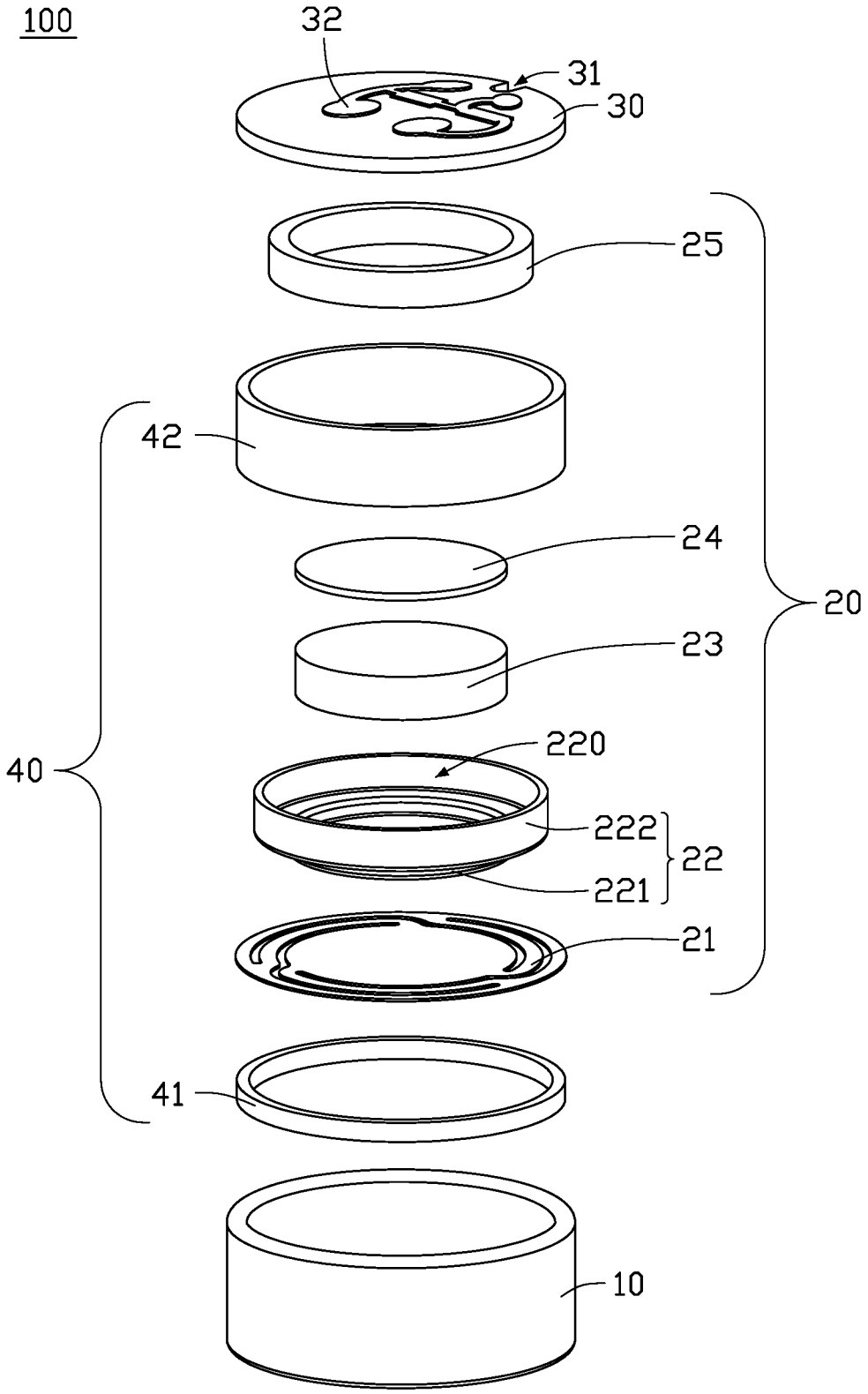
FIG. 2 is an exploded view of the bone conduction receiver of FIG. 1.

Referring to FIG. 1 and FIG. 2, a bone conduction receiver 100 is provided. The bone conduction receiver 100 can include an outer casing 10, a vibration unit 20, and a lid 30. The vibration unit 20 converts electrical signals into mechanical vibrations. The outer casing 10 is configured to receive the vibration unit 20. The lid 30 covers surfaces of the outer casing 10 to form a sealed first receiving space 101. The bone conduction receiver 100 further includes a fixing unit 40. The fixing unit 40 is configured to fix the vibration unit 20 in the first receiving space 101.

In the embodiment, the outer casing 10 is substantially cylindrical. The outer casing 10 defines the first receiving space 101 and a first opening. The first opening communicates with the first receiving space 101. The vibration unit 20 and the fixing unit 40 are arranged in the first receiving space 101 through the first opening. When the lid 30 covers the outer casing 10 at the first opening, the lid 30 seals the first receiving space 101 to form the sealed first receiving space 101.

In the embodiment, the vibration unit 20 can include a vibration reed 21, a holder 22, a magnet 23, a washer 24, and a coil 25. The fixing unit 40 includes a cushion ring 41 and a supporting base 42.

Figure 3:
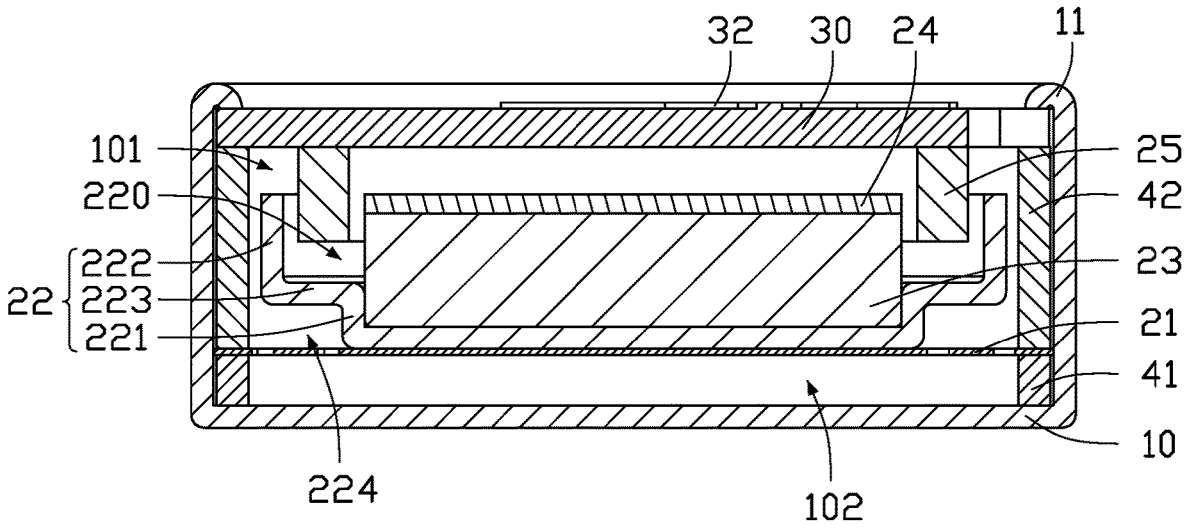
FIG. 3 is a cross-sectional view along line A-A of FIG. 1

Referring also to FIG. 3, the cushion ring 41 is substantially ring-shaped. The cushion ring 41 is arranged on a bottom of the outer casing 10. The peripheral surface of the cushion ring 41 and an inner wall of the outer casing 10 abut each other.

The vibration reed 21 and an end of the cushion ring 41 away from the bottom of the outer casing 10 abut each other. The peripheral surface of the vibration reed 21 is coupled to the outer casing 10. The vibration reed 21 is spaced from the bottom of the outer casing 10 to form an empty space 102.

The holder 22 is arranged between the vibration reed 21 and the magnet 23. The holder 22 is configured to receive the magnet 23. In detail, the holder 22 is fixed at a side of the vibration reed 21 away from the cushion ring 41. In the embodiment, the holder 22 includes a first barrel member 221 and a second barrel member 222. The first barrel member 221 and the second barrel member 222 are both cylindrical in shape. An edge of an end of the first barrel member 221 away from the cushion ring 41 extends outside to form a connection member 223. The connection member 223 is coupled to an end of the second barrel member 222. A first space formed in the first barrel member 221 and a second space formed in the second barrel member 222 communicate with each other to form a second receiving space 220 and a second opening. The second opening communicates with the second receiving space 220 and is formed at an end of the holder 22 opposite to the vibration reed 21. An inner diameter of the first barrel member 221 is less than an inner diameter of the second barrel member 222. The magnet 23 is partially received in the first barrel member 221. The magnet 23 further extends toward the second barrel member 222. Thus, the magnet 23 is arranged on a side of the vibration reed 21 away from the bottom of the outer casing 10, and is spaced from an inner wall of the second barrel member 222.

Figure 4:
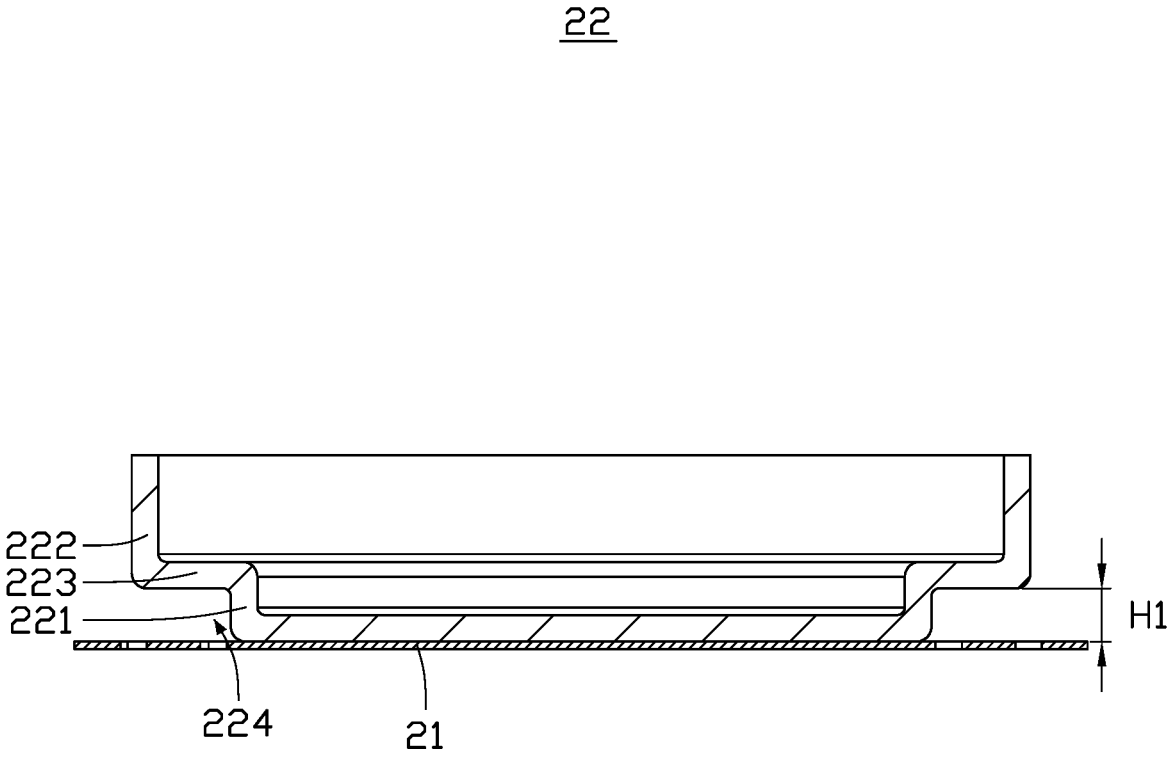
FIG. 4 is a cross-sectional view of a holder and a vibration reed of the bone conduction receiver of FIG. 3.

Referring also to FIG. 4, it can be understood that the first barrel member 221 is adjacent to the vibration reed 21. The connection member 223 and the vibration reed 21 form a gap 224. When a height H1 of the gap 224 increases, resonant properties of the bone conduction receiver 100 are enhanced.

The washer 24 is arranged at a side of the magnet 23 away from the vibration reed 21. The washer 24 amplifies magnetic induction lines. Thus, a utilization of the magnet 23 can be improved, and an operating power and a bandwidth of the bone conduction receiver 100 are enhanced. An integral acoustic performance of the bone conduction receiver 100 can accordingly be improved.

The supporting base 42 is substantially in a ring shape. The supporting base 42 is arranged on the side of the vibration reed 21 away from the cushion ring 41. The supporting base 42 surrounds the holder 22 and the magnet 23. A height of the supporting base 42 is greater than a height of the holder 22. An end of the supporting base 42 away from the vibration reed 21 and the lid 30 abut each other.

The coil 25 is made of wound wire. The coil 25 is substantially in a ring shape. A first end of the coil 25 is fixed to an inner surface of the lid 30, and a second end of the coil 25 extends into the first receiving space 101 and coils around the magnet 23 and the washer 24. Namely, the coil 25 surrounds the magnet 23 and the washer 24, and is spaced from an outer wall of the magnet 23 and an inner wall of the second barrel member 222.

In the embodiment, the lid 30 is a printed circuit board. The lid 30 further defines a cutout 31. The cutout 31 is configured to provide a passage for wires of the coil 25 to pass through, thus electrical signals representing sound can be imported through the lid 30 for the coil 25. The cutout 31 can be sealed with sealant or a waterproof membrane arranged on the lid 30 at the cutout 31, thus a seal of the bone conduction receiver 100 can be ensured.

In the embodiment, the bone conduction receiver 100 includes a filter circuit 32. The filter circuit 32 is arranged on an outer surface of the lid 30 away from the coil 25. The filter circuit 32 is configured to filter out noise of the bone conduction receiver 100 generated during operations. Thus, articulation and sound quality of the sounds transferred by the bone conduction receiver 100 is improved, and the experience of the user is accordingly improved.

Electrical signals are fed into the coil 25, and because the coil 25 is arranged in gap of magnet circuit of the magnet 23, the magnet 23 and the holder 22 are driven to vibrate mechanically, by electromagnetic induction. Thus, the electrical signal representing sound can be converted into mechanical vibration with different frequencies, and sound waves can be transferred to user via skull, inner ear lymphs, and so on.

To assemble the bone conduction receiver 100, the holder 22 is fixed on a surface of the vibration reed 21, and the magnet 23 is adhered to the first barrel member 221 of the holder 22. Thus, the vibration reed 21, the holder 22, and the magnet 23 are a first assembly. The coil 25 is adhered to an inner surface of the lid 30, thus the coil 25 and the lid 30 amount to a second assembly. The cushion ring 41, the first assembly, the supporting base 42, and the second assembly are placed in sequence in the first receiving space 101 of the outer casing 10. Thus, a surface of the vibration reed 21 and an end of the cushion ring 41 resist against each other, and the inner surface of the lid 30 covering the coil 25 and the end of the supporting base 42 resist against each other. An edge of an end of the outer casing 10 with the first opening is bent inwardly to form a limiting member 11. The limiting member 11 and the outer surface of the lid 30 away from the coil 25 resist against each other. Thus, the outer casing 10 and the lid 30 are rivetted together. A seal of the bone conduction receiver 100 can be ensured, and the bone conduction receiver 100 made waterproof.

In the embodiment, the outer casing 10 is a metal casing. A material of the outer casing 10 is aluminum, aluminum alloy, copper, or German silver.

In the embodiment, a range of the height H1 of the gap 224 is from 0.3 millimeters to 1 millimeter.

It can be understood that the disclosure can be achieved by several types of connection, for example by a soldering manner, an adhering manner, and a riveting manner. A builder in the art can select a suitable connection manner according to the need, which is not described in detail herein.

Figure 5:
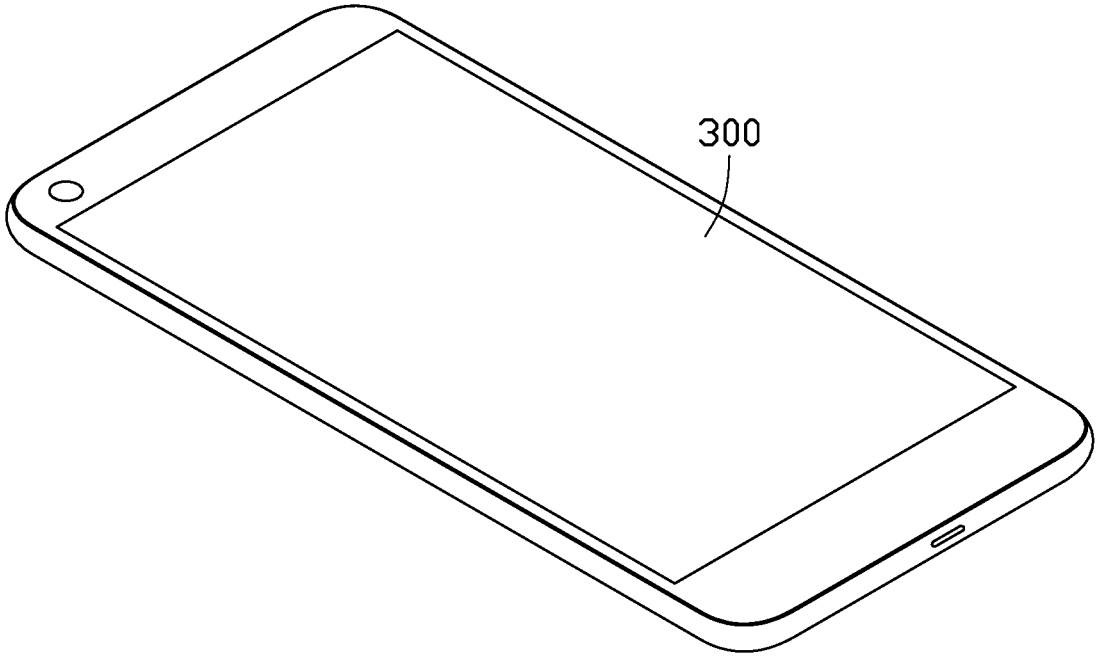
FIG. 5 is an electronic device containing the bone conduction receiver of FIG. 1

The bone conduction receiver 100 is installed in an electronic device 300, as shown in FIG. 5. FIG. 5 illustrates a mobile phone only, but a person in the art will know that the electronic device 300 can be any suitable device, for example, an earphone, a wearable device, or the like. The bone conduction receiver 100 is configured to convert audio electrical signals into mechanical vibrations, thus audio playback by the electronic device 300 can be achieved.

It can be understood that, in the disclosure, the washer 24 is arranged on a surface of the magnet 23 to amplify magnetic induction lines, thus utilization of the magnet 23 can be improved, and accordingly an integral acoustic performance of the bone conduction receiver 100 can be improved. The outer casing 10 and the lid 30 are rivetted, ensuring a waterproof seal of the bone conduction receiver 100. The filter circuit 32 is arranged on the outer surface of the lid 30, thus the noise generated by the bone conduction receiver 100 during operations can be filtered, and the experience of the user can be accordingly improved.

It should be noted that, the above embodiments are merely to illustrate, they are not intended to be limiting. Although the preferred examples with reference to the present disclosure have been described in detail, a person skilled in the art will know that the present disclosure may be modified or use equivalents without departing from the spirit and scope of the present disclosure.

What is claimed is:

1. A solid-medium sound conducting receiver comprising:
an outer casing;
a lid covering surface of the outer casing to form a sealed first receiving space;
a vibration reed arranged in the first receiving space, a peripheral surface of the vibration reed being coupled to the outer casing;
a magnet arranged in the first receiving space, the magnet being arranged at a side of the vibration reed away from a bottom of the outer casing;
a washer arranged in the first receiving space, the washer being arranged at a side of the magnet away from the vibration reed; and
a coil arranged in the first receiving space, a first end of the coil being fixed to an inner surface of the lid, and a second end of the coil extending into the first receiving space and coiling around the magnet and the washer;
wherein the solid-medium sound conducting receiver further comprises a holder, the holder is arranged between the vibration reed and the magnet, the holder is configured to receive the magnet;
wherein the solid-medium sound conducting receiver further comprises a cushion ring, the cushion ring is arranged on the bottom of the outer casing, an end of the cushion ring away from the outer casing and the vibration reed abut each other.

2. The solid-medium sound conducting receiver according to claim 1, wherein the lid is a printed circuit board, the solid-medium sound conducting receiver further comprises a filter circuit, the filter circuit is arranged on an outer surface of the lid.

3. The solid-medium sound conducting receiver according to claim 1, wherein an edge of an end of the outer casing adjacent to the lid bends inwardly to form a limiting member, the limiting member and an outer surface of the lid away from the coil abut each other.

4. The solid-medium sound conducting receiver according to claim 1, wherein:
the holder comprises a first barrel member and a second barrel member;
the first barrel member and the second barrel member are both cylindrical, an edge of an end of the first barrel member extends outside to form a connection member, the connection member is coupled to an end of the second barrel member, a space formed in the first barrel member and a space formed in the second barrel member communicate with each other, an inner diameter of the first barrel member is less than an inner diameter of the second barrel member, the magnet is partially received in the first barrel member, the magnet further extends toward the second barrel member and is spaced from an inner wall of the second barrel member.

5. The solid-medium sound conducting receiver according to claim 4, wherein:
the first barrel member is adjacent to the vibration reed, and a gap exists between the connection member and the vibration reed.

6. The solid-medium sound conducting receiver according to claim 4, wherein:
the coil surrounds the magnet and the washer, the coil is spaced from an outer wall of the magnet and an inner wall of the second barrel member.

7. The solid-medium sound conducting receiver according to claim 1, wherein:
the solid-medium sound conducting receiver further comprises a supporting base, the supporting base is arranged on the side of the vibration reed away from the cushion ring, the supporting base surrounds the holder and the magnet, an end of the supporting base away from the vibration reed and the lid abut each other.

8. An electronic device comprising:
a solid-medium sound conducting receiver comprising:
an outer casing;
a lid covering surface of the outer casing to form a sealed first receiving space;
a vibration reed arranged in the first receiving space, a peripheral surface of the vibration reed being coupled to the outer casing;
a magnet arranged in the first receiving space, the magnet being arranged at a side of the vibration reed away from a bottom of the outer casing;
a washer arranged in the first receiving space, the washer being arranged at a side of the magnet away from the vibration reed; and a coil arranged in the first receiving space, a first end of the coil being fixed to an inner surface of the lid, and a second end of the coil extending into the first receiving space and coiling around the magnet and the washer;

wherein the solid-medium sound conducting receiver further comprises a holder, the holder is arranged between the vibration reed and the magnet, the holder is configured to receive the magnet;

wherein the holder comprises a first barrel member and a second barrel member; the first barrel member and the second barrel member are both cylindrical, an edge of an end of the first barrel member extends outside to form a connection member, the connection member is coupled to an end of the second barrel member, a space formed in the first barrel member and a space formed in the second barrel member communicate with each other, an inner diameter of the first barrel member is less than an inner diameter of the second barrel member, the magnet is partially received in the first barrel member, the magnet further extends toward the second barrel member and is spaced from an inner wall of the second barrel member.

9. The electronic device according to claim 8, wherein the lid is a printed circuit board, the solid-medium sound conducting receiver comprises a filter circuit, the filter circuit is arranged on an outer surface of the lid.

10. The electronic device according to claim 8, wherein an edge of an end of the outer casing adjacent to the lid bends inwardly to form a limiting member, the limiting member and an outer surface of the lid away from the coil abut each other.

11. The electronic device according to claim 8, wherein:

the first barrel member is adjacent to the vibration reed, and a gap exists between the connection member and the vibration reed.

12. The electronic device according to claim 8, wherein:

the coil surrounds the magnet and the washer, the coil is spaced from an outer wall of the magnet and an inner wall of the second barrel member.

13. The electronic device according to claim 8, wherein:

the solid-medium sound conducting receiver further comprises a cushion ring, the cushion ring is arranged on the bottom of the outer casing, an end of the cushion ring away from the outer casing and the vibration reed abut each other.

14. The electronic device according to claim 13, wherein:

the solid-medium sound conducting receiver further comprises a supporting base, the supporting base is arranged on the side of the vibration reed away from the cushion ring, the supporting base surrounds the holder and the magnet, an end of the supporting base away from the vibration reed and the lid abut each other.

15. A solid-medium sound conducting receiver comprising:

an outer casing;

a lid covering surface of the outer casing to form a sealed first receiving space;

a vibration reed arranged in the first receiving space, a peripheral surface of the vibration reed being coupled to the outer casing;

a magnet arranged in the first receiving space, the magnet being arranged at a side of the vibration reed away from a bottom of the outer casing;

a washer arranged in the first receiving space, the washer being arranged at a side of the magnet away from the vibration reed; and a coil arranged in the first receiving space, a first end of the coil being fixed to an inner surface of the lid, and a second end of the coil extending into the first receiving space and coiling around the magnet and the washer;

wherein the solid-medium sound conducting receiver further comprises a holder, the holder is arranged between the vibration reed and the magnet, the holder is configured to receive the magnet;

wherein the holder comprises a first barrel member and a second barrel member; the first barrel member and the second barrel member are both cylindrical, an edge of an end of the first barrel member extends outside to form a connection member, the connection member is coupled to an end of the second barrel member, a space formed in the first barrel member and a space formed in the second barrel member communicate with each other, an inner diameter of the first barrel member is less than an inner diameter of the second barrel member, the magnet is partially received in the first barrel member, the magnet further extends toward the second barrel member and is spaced from an inner wall of the second barrel member.

16. The solid-medium sound conducting receiver according to claim 15, wherein the lid is a printed circuit board, the solid-medium sound conducting receiver further comprises a filter circuit, the filter circuit is arranged on an outer surface of the lid.

17. The solid-medium sound conducting receiver according to claim 15, wherein an edge of an end of the outer casing adjacent to the lid bends inwardly to form a limiting member, the limiting member and an outer surface of the lid away from the coil abut each other.

18. The solid-medium sound conducting receiver according to claim 15, wherein:

the first barrel member is adjacent to the vibration reed, and a gap exists between the connection member and the vibration reed.

* * * * *